US005385492A

United States Patent [19]

Stuart

[11] Patent Number: 5,385,492

[45] Date of Patent: Jan. 31, 1995

[54] ELECTRICAL CONNECTOR DEVICE AND METHOD OF MANUFACTURE THEREOF

[75] Inventor: Ross M. Stuart, Tustin, Calif.

[73] Assignees: Edward W. Burger; John C. Harrington, III, both of Phoenix, Ariz.

[21] Appl. No.: 86,242

[22] Filed: Jun. 30, 1993

Related U.S. Application Data

[63] Continuation of Ser. No. 750,886, Jan. 28, 1992, Pat. No. 5,254,022, which is a continuation of Ser. No. 386,439, Jul. 28, 1989, abandoned.

[51] Int. Cl.[6] ..... H01R 4/10

[52] U.S. Cl. ..... 439/877; 439/682

[58] Field of Search ..... 439/877–879, 439/881, 882, 842, 843, 851, 853, 854, 855

[56] References Cited

U.S. PATENT DOCUMENTS 3,140,142 7/1964 Marquis ..... 439/877
3,332,054 7/1967 Fernandes ..... 439/877

FOREIGN PATENT DOCUMENTS 2378377 8/1978 France ..... 439/877

*Primary Examiner*—David L. Pirlot
*Attorney, Agent, or Firm*—Edward E. Roberts

[57] ABSTRACT

An electrical connector assembly in which the socket connector assembly is formed of seamless tubular members having a spring depression adjacent the open end thereof, the socket members being formed as a cantilevered array protruding from an insulative body. The pin connector assembly is formed of hollow closed end tubular configuration arranged in an array within an insulating sleeve or body. Electrical conductor connection is effected by crimping tubular attachment portions of the pins and sockets into a "D" shaped configuration.

7 Claims, 2 Drawing Sheets

FIG. 1
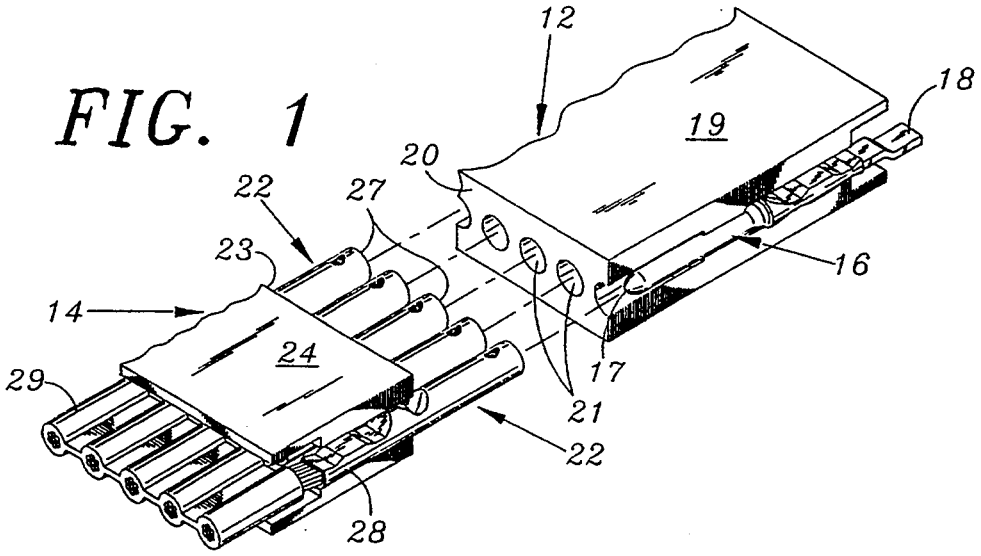
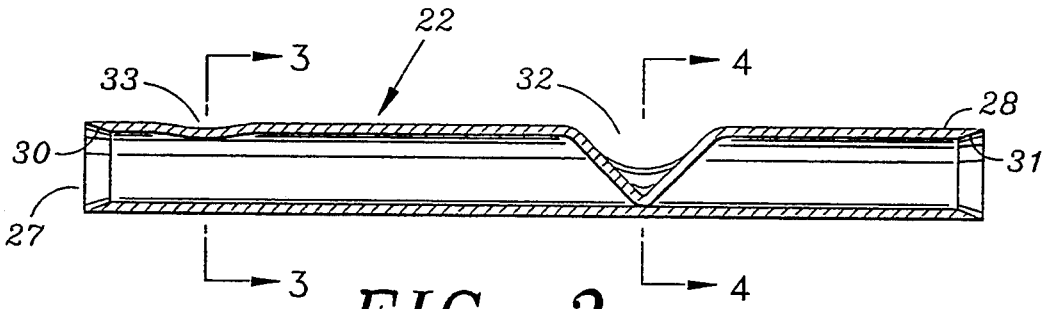
FIG. 2
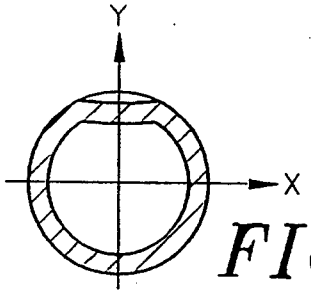
FIG. 3
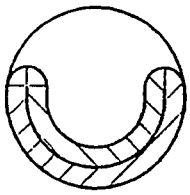
FIG. 4
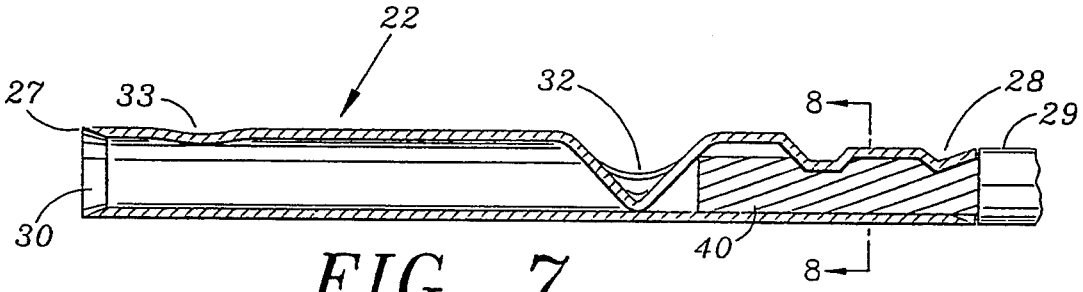
FIG. 7

ELECTRICAL CONNECTOR DEVICE AND METHOD OF MANUFACTURE THEREOF

This is a continuation of pending application Ser. No. 07/750,886 filed on Jan. 28, 1992, now U.S. Pat. No. 5,254,022 which is a continuation of Ser. No. 386,439 now abandoned, filed Jul. 28, 1989.

BACKGROUND OF THE INVENTION

The background of the invention will be discussed in two parts.

Field of the Invention

This invention relates generally to the electrical connector devices, and more particularly to an electrical connector device and the method for manufacturing the same.

Description of the Prior Art

Electrical contact assemblies for electronic systems and devices have been utilized extensively. In many instances such contact assemblies are employed to facilitate initial fabrication and ultimately to facilitate service or replacement of subcomponents on a modular basis. One of the more commonly employed type of electrical contact assembly includes a plurality of contact elements, such as contact pins, in an array within an insulative body, for mating connection to a like number of arrayed aligned contact sockets configured for receiving the pins in sliding relation. Such electrical contact assemblies include some means for providing friction for insertion and retention of the pin within the socket. Such friction is typically accomplished by configuration of the socket with longitudinally extending slots or kerfs. In other such devices, the socket may be provided with a circumferentially reduced diameter portion.

In any event, with miniaturization and microminiaturization of electronic components and subassemblies, demands have been placed on manufacturers of electrical contact assemblies for smaller and smaller devices. Wiring techniques have progressed to "ribbon" conductors in which a generally flat ribbon or sheath incorporates an aligned row of a plurality of stranded or braided, very small gauge, conductors, equally spaced across the width of the ribbon. To facilitate coupling, connectors have been developed for "matching up" to the conductor spacing.

Electrical contact assemblies have been reduced in size to the point where contact pins may have a dimension in the order of 0.0125 inches for insertion in a socket having an outer diameter of 0.018 inches with adjacent sockets spaced on 0.025 inch centers providing a density of about 1000 contacts per square inch. Such reductions in size are accompanied by corresponding problems. One basic problem relates to the very small dimensions of both the contact pin and the socket, whereby the slightest transverse force can result in bending, or even breakage. In addition the contact assemblies must be capable of repeated insertions and withdrawals without significant distortion of the interconnecting parts which could result in lack of electrical integrity.

In providing electrical interconnection between fine gauge ribbon conductors and the connectors, soldering has been replaced by mechanical means, such as crimping. For crimping purposes, a portion of the insulator surrounding the conductor is removed exposing a length of each conductor in the ribbon. The conductors are positioned within tubular portions of the contact pin or socket and mechanical force is applied to deform the tubular portion to provide a mechanical coupling of the conductor therein. Such crimping may take any convenient form, but typically results in the crimped cross-section being in the shape of a star or figure eight, that is, the crimping force is applied from diametrically opposite sides of the tubular portion along a line. The crimping must be accomplished in such a manner that the strands of the conductor are not broken and must enable the conductor to be retained therein despite a pull in the axial direction of a minimum predetermined force.

In such connector assemblies, electrical contact in the separable sliding or telescoping members requires a minimum normal force between the members to establish a low electrical resistance gas tight junction. The normal force required varies with the metallic materials involved as well as the surface finish, roughness, plating and oxide films.

The most common contact system employed in electrical connector assemblies consists of a male contact or pin that telescopes into a female "spring" contact. The shape of the pin and socket may be round, square, triangular or rectangular in cross-section. Most spring sockets are designed of simple end supported beams formed by strips or longitudinal slotting, all of which are fabricated to provide one or more longitudinal arms that flex or deflect transversely, to provide the normal force to effect the electrical contact, when mated with the male member.

As a consequence of this geometry, the spring socket contact is lengthened. Furthermore, to test electrical circuits it is necessary to insert a probe into the spring socket and care must be exercised to ensure that the spring elements are not deflected beyond their elastic limits. To avoid such danger the common practice is to house the spring socket in a close fitting support sleeve or shroud as an integral part of the socket, or ensure that the cavity surrounding the contact provides the support to prevent this probe damage. Partially for this reason it is customary to house the socket within the insulator, and employ exposed cantilever contact pins for the mating connector. As a result of this geometry the more fragile member of the contact system is exposed and more easily damaged or bent.

An example of a connector assembly is shown and described in U.S. Pat. No. 3,047,832, issued to Deakin on Jul. 31, 1962, for "Electrical Socket Contacts" in which the socket is formed from bent sheet metal to define a longitudinal path for receipt of a contact pin, with the socket configuration providing spring action frictional resistance therebetween.

Another electrical connector assembly is shown and described in U.S. Pat. No. 3,277,422, issued to Shevlin on Oct. 4, 1966, for an "Electrical Connector Having Shrouded Pin Contacts". In this assembly the contact pins are encased in insulative material with a sleeve or shroud about the pin array. Similarly, the tubular socket members are encased in insulative material with a sleeve or shroud about the socket array.

Another electrical connector assembly is shown and described in U.S. Pat. No. 3,281,760, issued Oct. 25, 1966, to Shintaro Oshima et al, for "Electrical Connection Elements and Connectors", in which the geometric cross-sectional configurations of the plugs or pins are dissimilar from that of the jacks or sockets, thus creating longitudinal electrical contact and friction during insertion and retention due to the attempt of the plug to deform the jack.

A contact plug or pin is shown and described in U.S. Pat. No. 3,786,558, issued to McCarthy on Jan. 22, 1974, for a "Method of Making a Hollow Electrical Contact", in which the hollow contact is provided with spring action by longitudinal slotting.

U.S. Pat. No. 4,343,384, issued Aug. 10, 1982, to Mutter, for "Connector Apparatus for Electrically Conductive Guide Rails", and discloses axially slotted members and the fabrication thereof.

Another "Terminal Plug Body and Connector" is shown in U.S. Pat. No. 4,660,922, which issued to Cooney et al on Apr. 28, 1987.

U.S. Pat. No. 4,687,278, entitled "Contact Socket with Improved Contact Force" issued to Grabbe et al on Aug. 18, 1987 and discloses a square pin for insertion into a socket having four longitudinally extending beam portions flexed into the socket opening for contact with the square pin. Another spring contact jack is shown and described in U.S. Pat. No. 4,752,253, entitled "Contact Element and Method of Manufacturing", which patent issued Jun. 21, 1988, to Neumann et al, the contact having a plurality of mutually laterally disposed spring contacts arranged and dimensioned for contact with the sides of a plug inserted therein.

A similarly configured spring socket contact is shown and described in U.S. Pat. No. 4,753,616, entitled "Contact Element for an Electrical Plug Connector", which issued to Molitor on Jun. 29, 1988.

In accordance with an aspect of the invention, it is an object of the present invention to provide a new and improved electrical connector assembly and method for the manufacture thereof.

SUMMARY OF THE INVENTION

The foregoing and other objects of the invention are accomplished by providing an electrical connector assembly in which the socket connector assembly is formed of seamless tubular members having a spring depression adjacent the open end thereof, the socket members being formed as a cantilevered array protruding from an insulative body. The pin connector assembly is formed of hollow closed end tubular configuration arranged in an array within an insulating sleeve or body. Electrical conductor connection is effected by crimping tubular attachment portions of the pins and sockets into a "D" shaped configuration.

Other objects, features and advantages of the invention will become apparent from a reading of the specification when taken in conjunction with the drawings, in which like reference numerals refer to like elements in the several views.

BRIEF DESCRIPTION OF THE DRAWINGS

FIG. 1 is a perspective view, partially broken away, of an electrical connector assembly according to the invention;

FIG. 2 is a cross-sectional view of a socket member of the connector assembly of FIG. 1;

FIG. 3 is a cross-sectional view of the socket member of FIG. 2 as viewed along line 2—2 thereof showing details of the spring depression;

FIG. 4 is a cross-sectional view of the socket member of FIG. 2 as viewed along line 2—2 thereof showing details of the conductor lead stop portion;

FIG. 7 is a cross-sectional view of the socket member similar to FIG. 2 showing the details of the connection of a conductor therein;

DESCRIPTION OF THE PREFERRED EMBODIMENTS

Figure 5:
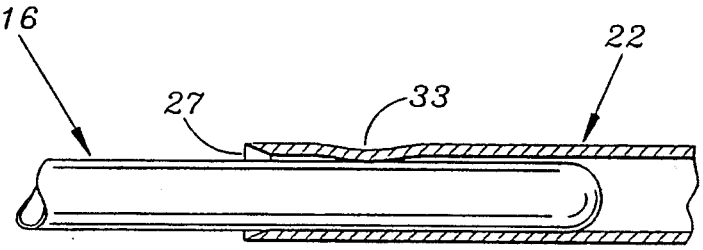
FIG. 5 is a view showing the engagement of a contact pin within a cross-sectional view of a portion of the socket member of FIG. 1.
Figure 6:
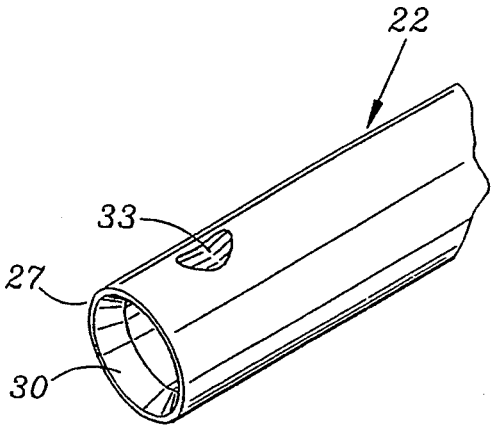
FIG. 6 is an enlarged perspective view of the pin-engaging end of the socket member of FIG. 2.

Referring now to the drawings, and particularly to FIGS. 1 and 2, there is shown an electrical connector assembly including a pin connector assembly, generally designated 12, and a socket connector assembly, generally designated 14. The pin connector assembly 12 includes an array of pins 16, that is, a plurality of row aligned generally parallel, equally spaced contact pins, generally designated 16 (only one of which is shown), each of which is generally identical, the contact pins 16 being formed as hollow closed end members. The closed end 17 is rounded and configured for insertion into a corresponding electrical socket member 22. The opposite end 18 is configured in any convenient manner for suitable attachment to a conductive member (not shown) such as an electrically conductive cable member.

The plurality of contact pins 16 are maintained in a generally parallel equally spaced orientation and in row alignment (that is, the longitudinal axes thereof lie in a common plane) by the method of embedding or molding the pins 16 into a common cubically configured connector body 19 formed of a suitable insulation material. Formed within a generally planar face 20 of the body coaxial with the pins 16 are a like number of pockets or cylindrically configured recesses 21, each of which is configured, dimensioned and arranged to receive the pin 16 in coaxial relation therein with the end 17 inwardly spaced from the open end of the recess 21. For a given length, the inner diameter of the recess 21 is such that it is greater than the outer diameter of the pin 16, with the inner diameter of the recess 21 being sufficient for receipt therein of the socket 22, as will be described. In this manner, the fragile pins 16 are protected by a shroud or housing, wherein the insulating material of the body 19 provides protection against bending or breakage.

The socket connector assembly 14 is configured of a mating array, that is, a like plurality of row aligned tubular socket members, generally designated 22, each of which is generally identical and formed of tubular seamless electrically conductive material. In the preferred embodiment, both the pin 16 and the socket member 22 are formed of gold plated conductive metallic material to meet the demanding requirements of today's electronic devices.

The socket members 22 are maintained in aligned row oriented relation (that is, the longitudinal axes thereof lie in a common plane), by means such as embedment or molding within a body 24 of suitable insulating material.

However, the socket members 22 are cantilevered, that is the free ends 27 project out from the end face 23 of the body 14 a distance sufficient for enabling insertion of the tubular socket members 22 into the matingly formed recesses 17 of the body 14 for electrically conductive engagement with the pins 16. For this purpose, the outer diameter of the pins 16 is slightly smaller than the inner diameter of the tubular socket member 22. The end face 23 of the socket connector assembly 14 is configured and dimensioned generally identically to the end face 20 of the pin connector assembly 12. With the socket members 22 engaging the pins 16 the faces 23 and 20 are in planar abutting relation. The opposite ends 28 of the socket members 22 are configured for receipt of electrically conductive means, such as a ribbon conductor 29 in a securement manner which will be hereafter described.

As shown more particularly in FIG. 2, the socket members 22 are configured to perform four functions, one being the provision of a spring action relative to the pins 16, the second being to provide a wire or conductor stop, the third being to provide means for facilitating receipt of the pins 16 and the fourth being to provide means for receipt of the wire or electrical conductor of the ribbon conductor.

The end 27 of the socket member 22 is provided with means to facilitate entry of the rounded end 17 of the pin 16 by providing a chamfered or tapered inner opening 30, with a similarly configured tapered inner opening 31 at the opposite end to facilitate entry of an electrical conductor. A wire stop for the conductor is formed by a V-shaped depression 32 formed a distance from the end 28, which distance approximates one-third the length of the member 22. The angle of the V-shaped depression is about 60 degrees. As shown in FIG. 4, the extent of the depression 32 is sufficient to effect closure of the inner diameter of the member 22 to partially assist in providing a gas-tight closure, with the principal means of effecting a gas-tight fitting being described hereafter.

For spring action during insertion of the pin 16 into the socket member 22, a generally oval-shaped depression 33 of a controlled depth is provided by controllably depressing the outer surface of the socket member 22 adjacent the end 27. The long axis of the oval-shaped depression 33 is aligned with the longitudinal axis of the socket member 22. To provide optimum spring action, the depression 33 is formed at a predetermined distance from the end 27, this distance being correlated to the diameter of the tubing employed. If the depression were to be located adjacent the opening 27 of the socket member 22, insertion of the pin 16 therein would be more difficult. In the preferred embodiment, the center of the depression 33 is selected such that the distance between that center and the end 27 is approximately equal to one outer diameter of the tubing, but in no event more than four diameters in distance. By reference to FIG. 3, during the formation of the depression 33, the socket member 22 at the zone of formation of the depression 33 is slightly elliptical, that is the distance in the "X" direction is slightly greater than the distance in the "Y" direction. The combination of the depression 33 and the slightly elliptical shape of the socket member 22 at the zone of formation provides a spring engaging force for the pin 16 when inserted into the socket member 22.

As shown also in FIGS. 3 and 4, the depth of the depression 33 is selected to be sufficient to minimize stress concentration. This is accomplished by providing a depression with a given radius in the axial direction of the tubular socket member 22, this given radius having a center offset from the tubular member and being sufficiently large to minimize stress concentration. In the preferred embodiment, the given radius is approximately twice the radius of the inner opening of the tubular socket member 33. The depth of the depression 32 is selected to produce a certain engaging force for holding the pin 16 in place thereof, that is, a minimum amount of frictional engagement must be accomplished, this engaging force for pins 16 of 0.0130 to 0.0124 inch being within the range of 0.25 ounce to 1.5 ounce. Overall, the depression 33 is formed, configured, dimensioned and arranged to preclude localized stress concentration while providing the required spring engagement force. It is not a sharp indentation, but a smoothly flowing depression in a tubular surface positioned at a point to provide a spring force after the pin 16 has been inserted a short distance into the socket member 22.

The engagement of the pin 16 within the socket member 22 is shown in FIG. 5. During insertion of the pin 16, initially, the tapered inner opening 30 serves to facilitate entry of the pin 16. As the pin 16 continues into further engagement within socket member 22 until the upper edge of the pin 16 meets with a spring force or friction at the inner surface of the depression 33. At the point where the pin 16 is in the position shown in FIG. 5, the outer diameter of the pin 16 urges against the inner surface of the depression 33, thus attempting to restore the inner diameter of the socket member 22 at that point from a slightly elliptical configuration to a round or circular configuration, and further attempts to force the depression 33 upwardly (as viewed in the drawing). The lower lineal edge of the pin 16 is thus forced against the lower (as viewed in the drawing) inner surface of the socket member 22 thus providing a continuous line of electrical contact between the pin 16 and the inner surface of the socket member 22. In other words, a significant portion of the area of the pin 16 is in good mechanical and electrically conductive contact with the arcuate inner lower surface of the socket member 22 along a line diametrically opposite the lowest inner point, or geometric center, of the depression 33.

In this manner there is provided a connector assembly in which the socket member assembly 14, with the larger diameter and thus stronger connector elements are cantilevered and exposed for insertion into the recesses 21 of the connector pin assembly 12, for coupling of the pins 16 within the socket members 22 in electrically conductive mating relation along a major arcuate portion of the adjoined surfaces under force of the spring means provided by the depressions 33 formed in the socket members 22.

In critical environments, such as in aircraft and aerospace application, it is essential that a gas-tight connection be provided in such electrical connector assemblies. A gas-tight connection is essentially a seal which precludes the entry of corrosive gasses and thus precludes the formation of films on the interconnected metallic parts which would increase the electrical resistance of the thus electrically connected parts, and eventually cause failures through filming or corrosion. To accomplish this, by reference to FIGS. 1, 7 and 8, the end 28 of the socket member 22 is configured for receiving therein a conductor 40 of the ribbon conductor 29. As shown in the ribbon conductor 29 is formed with a plurality of conductors 40 within a common sheath insulator, with the conductors 40 aligned in a row corresponding to the number of row aligned socket members 22. A similar arrangement is provided for the pins 16 of the pin connector assembly 12 and the method of attachment will be the same.

Figure 10:
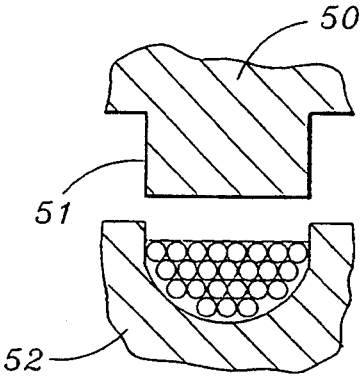
FIG. 10 illustrates how the flow of metal in the D-crimp changes the shape of the crimped conductor.
Figure 8:
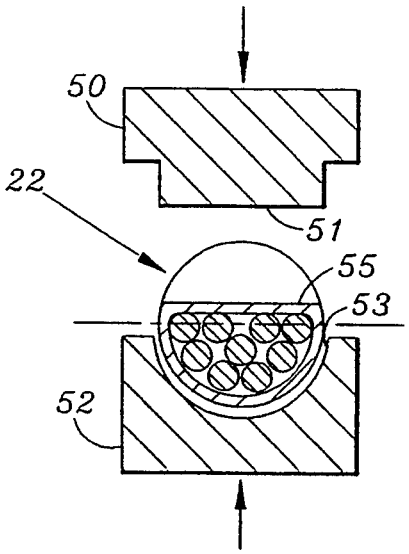
FIG. 8 is a cross-sectional view of the socket member of FIG. 7 as viewed along line 8—8 thereof with first and second die members in spaced relation thereto.

By reference particularly to FIGS. 7, 8 and 10, a stranded or braided exposed conductor 40 is inserted into the open end 28 of the socket member 22 until the free end thereof abuts against the conductor or wire stop 32. Crimping is then utilized to secure the conductor 40 within the end 28 of the socket member 22.

Figure 9:
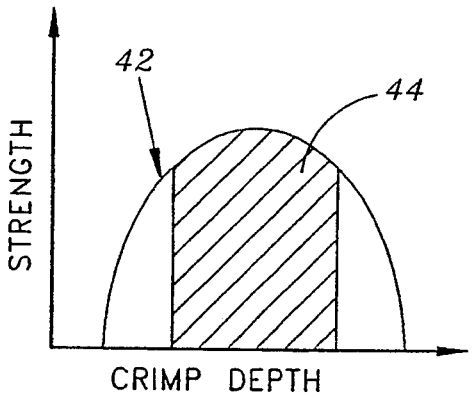
FIG. 9 is a graph depicting the relationship between crimp depth and strength of the resulting component.

Crimping of a tubular member creates certain stresses within the metal and thus should be undertaken with care, that is, the depth of the crimp must be sufficient to provide the desired clamping action while being of a depth not overly deep as to affect the strength of the completed part. FIG. 9 depicts a general graphical relation between the depth of the crimp and the strength of the assembled component part. As shown by the crimping curve 42, the strength of the part is plotted along the vertical axis with the depth of the crimp plotted along the horizontal axis. The curve 42 is of a parabolic form with the strength increasing along with the depth of the crimp until a certain point and then reverses thereafter. The center portion 44 of the graph 42 is shown with shading, this portion being that portion which provides the optimum, that is, within this shaded area, and acceptable strength results with the crimp depth falling within this range.

To effect this optimum crimp, the interconnection between the tubular end 28 of the socket member 22 and the wire or conductor 40 is carefully controlled. The conductor is normally formed of a soft electrically conductive material, such as copper or an alloy thereof. In order to accomplish this, ordinary crimping will not suffice. By reference to FIGS. 8 and 10, an upper die 50 and a lower die 52 are depicted for receiving the portion of the socket member 22 therein. The upper die 50 is provided with a protuberance 51 which has generally planar surfaces, with the width of the protuberance corresponding generally to the outer diameter of the tubular socket member 22. The lower die 52 is provided with a generally D-shaped cavity 53 formed therein, that is, it is generally semi-circular with the upper opposite surfaces approaching a generally parallel orientation. The depth of the lower cavity 53, when mated with the extention of the upper protuberance 51 is such that the resulting "D-crimp" 55 is configured as indicated in FIGS. 8 and 10, with the upper edge of crimp 55 defining a line parallel to and above the centerline "CL" of the tubular socket member 22. The D-shape of the crimp 55 means that in cross-section it resembles a "D" with a leg or linear portion **55*a* and an arcuate or curved portion 55*b***. In other words the metal crimping is controlled downwardly to a plane parallel to and spaced above the diameter of the tube, with the tube being crimped less than one-half a diameter.

During this application of force within the upper and lower dies, the pressure is controlled to effect a flowing of the metal of the seamless tubular socket member 22. The flow is controlled particularly at the juncture of the two dies 50, 52. The tubular socket member 22 at the outset is circular in diameter. That portion of the tube sidewall above the diameter or centerline is converging inwardly toward the top. The depth of the cavity 53 of the lower die 52 is more than one-half the diameter approaching two thirds of the diameter.

Thus, that portion of the sidewalls above the centerline 22 flows outwardly during compression under the restraint of the cavities, wherein the upper lateral edges of the lower cavity 53 approach a vertical in generally parallel relation. This then causes a cold metal flow to fill the void formed by the combined cavities. The walls of the tube in this crimped area 55 thus thicken, with the strands of copper conductor 40 therein also compressing and somewhat flowing to effect the required gas-tight seal.

It is to be understood that for the multiple conductor ribbon conductor 29, a multiple cavity die arrangement would be utilized to effect simultaneous crimping of a row of socket members 22 (or pin members 16). In accordance with the electrical connector assembly shown and described herein, there is provided an assembly in which the conductor/connector interconnections are gas-tight, with an economically fabricated assembly providing protection for the weaker pin 16 connectors, with the socket members 22 configured for permitting ease of insertion of the pins 16 therein, while providing spring means in the form of a contoured depth controlled depression at a location spaced from the insertion opening. While the pin 16 and socket member 22 configuration has been described as a row aligned orientation, any convenient mating array can be utilized.

While there has been shown and described a preferred embodiment, it is to be understood that various other adaptations and modifications may be made within the spirit and scope of the invention.

What is claimed is:

1. An electrical connector assembly comprising:

a) a pin connector assembly including i) a pin member insulating body means having a recess formed in a face thereof;

ii) a pin member in said recess formed of electrically conductive material terminating at or inwardly of said face;

b) a socket connector assembly including i) socket member insulating body means having a portion thereof for abutting coaction with the face of said pin connector assembly body means;

ii) a generally tubular socket member projecting out from said socket member insulating body means and configured, dimensioned and arranged for mating coaction with said pin member within said socket member, the inner configuration of said recess generally corresponding to the outer configuration of said socket member;

iii) said socket member including spring means formed as at least one depression adjacent the insertion end of said socket member a distance from the end thereof sufficient to enable partial insertion of the pin member within the socket member prior to engagement with said depression, said distance being within a range of one to four times the outer diameter of said socket member, and said depression configured in shape and depth for urging the pin member after insertion therethrough into abutting electrical engagement with the opposite inner sidewall of said socket member to thereby produce an engaging force for holding said pin member;

iv) said depression being generally oval-shaped with the long axis of the oval in axial alignment with the longitudinal axis of said socket member, and having a radius of curvature in the axial direction of said socket member approximately equal to twice the radius of the opening of said socket member;

v) electrical conductor stop means formed in said socket member for enabling positioning of said pin member within said socket member a selected distance from the insertion end thereof; and vi) said tubular socket member is circular in cross section and said pin member stop means is a generally V-shaped depression in said socket member having a depression angle of approximately 60 degrees.

2. The electrical connector assembly according to claim 1 wherein said pin connector assembly insulating body means has an array of recesses with a pin member in each recess and said socket connector assembly has an array of socket members for mating coaction with respective ones of said pin members.

3. The electrical connector assembly according to claim 1, including crimp means for forming a crimp in said socket member at a position for depressing the material thereof under pressure into substantially gas-tight frictional engagement with the conductor therein, said crimp being generally D-shaped.

4. The electrical connector assembly according to claim 3 wherein said D-shaped crimp has a linear portion and a curved portion with the linear portion being in spaced generally parallel relation with a line extending through the diameter of said socket member at a position displaced from said line so that the depth of the crimp is less than the radius of the socket member.

5. A socket connector assembly for use with a pin connector assembly having an array of recesses formed in a face thereof, with a pin member in each of said recesses, each of said pin members being generally identical and formed of electrically conductive material, with each of said pin members terminating at or inwardly of said face, said socket connector assembly comprising:

insulating body means including an array of generally tubular socket members cantilevered therefrom, said socket members being configured, dimensioned and arranged for mating coaction with said pin members, generally V-shaped pin member stop means having a depression angle of approximately 60 degrees formed in each of said socket members for enabling positioning of said pin member within said socket member a selected distance from the insertion end thereof;

spring means formed adjacent the cantilevered free end of each of said socket members, said spring means including at least one depression adjacent the insertion end of said socket member a given distance from the end thereof sufficient to enable partial insertion of the pin member within the socket member prior to engagement with said depression, said depression urging the pin member after passage therethrough into abutting electrically engagement with the opposite inner sidewall of said socket member; and said depression is a generally oval-shaped depression configured in shape and in depth in a manner to avoid local stress in said socket member with the long axis of the oval in axial alignment with the longitudinal axis of said socket member, said given distance is a distance within a range equal to one to four times the outside diameter of said socket member, and said depression has a radius of curvature in the axial direction of said socket member approximately equal to twice the radius of the opening of said socket member.

6. The socket connector assembly according to claim 5 wherein said tubular socket members are circular in cross-section and said pin members have rounded ends for engagement with said socket members and said socket members have chamfered ends for facilitating such engagement.

7. The socket connector assembly according to claim 6 further including ribbon conductor means and means for securing the conductors of said ribbon conductor means to said socket members.

* * * * *